US012667881B2

(12) United States Patent
Takahashi et al.

(10) Patent No.: US 12,667,881 B2
(45) Date of Patent: Jun. 30, 2026

(54) HOT-PRESS MOLDING APPARATUS, AUTOMOTIVE BODY COMPONENT, HOT-PRESS MOLDING METHOD, AND AUTOMOTIVE BODY COMPONENT MANUFACTURING METHOD

(71) Applicant: G-TEKT CORPORATION, Saitama-city (JP)

(72) Inventors: Satoshi Takahashi, Tokyo (JP); Hiroki Itoi, Tokyo (JP)

(73) Assignee: G-TEKT CORPORATION, Saitama-City (JP)

( * ) Notice: Subject to any disclaimer, the term of this patent is extended or adjusted under 35 U.S.C. 154(b) by 346 days.

(21) Appl. No.: 18/258,496

(22) PCT Filed: Nov. 15, 2021

(86) PCT No.: PCT/JP2021/041842
§ 371 (c)(1),
(2) Date: Jun. 20, 2023

(87) PCT Pub. No.: WO2022/145139
PCT Pub. Date: Jul. 7, 2022

(65) Prior Publication Data

US 2024/0033802 A1 Feb. 1, 2024

(30) Foreign Application Priority Data

Dec. 28, 2020 (JP) ..... 2020-219128

(51) Int. Cl.
*B21D 22/20* (2006.01)
*B21D 22/26* (2006.01)
(Continued)

(52) U.S. Cl.
CPC ..... *B21D 22/208* (2013.01); *B21D 22/26* (2013.01); *B21D 24/04* (2013.01); *B21D 24/16* (2013.01); *B21D 28/14* (2013.01)

(58) Field of Classification Search
CPC ..... B21D 22/208; B21D 22/26; B21D 24/04; B21D 24/16; B21D 28/14; B21D 22/022; B21D 37/16
See application file for complete search history.

(56) References Cited

U.S. PATENT DOCUMENTS 7,842,142 B1 * 11/2010 Kusumi ..... C21D 1/673 148/531
2010/0126640 A1 5/2010 Fang
(Continued)

FOREIGN PATENT DOCUMENTS

JP 07-009239 A 1/1995
JP 08-290219 A 11/1996
(Continued)

OTHER PUBLICATIONS

Decision to Grant a Patent received for Japanese Patent Application No. 2020-219128, mailed on Sep. 7, 2021, 6 pages (2 pages of English Translation and 4 pages of Original Document).
(Continued)

*Primary Examiner* — Teresa M Ekiert
(74) *Attorney, Agent, or Firm* — WOMBLE BOND DICKINSON (US) LLP

(57) ABSTRACT

A hot-press molding apparatus includes an upper mold (14) having a molding surface for molding a to-be-molded portion (4) of a metal sheet material (2) and a blade (32*a*) serving as a punch (32), a lower mold (13) having a molding surface (21) for molding the to-be-molded portion by sandwiching it in cooperation with the upper mold, and a die (16) configured to separate, from the to-be-molded portion, a trimming portion (3) positioned outside the to-be-molded
(Continued)

portion in the metal sheet material in which the to-be-molded portion is molded by the upper mold and the lower mold, in cooperation with the blade of the upper mold. An outer side surface (14*a*) of the upper mold is so formed as to extend in the cutting direction of the punch, and defines, on the side of the upper mold, a cooling suppression space (62) to which the trimming portion is exposed and which suppresses cooling of the trimming portion. A hot-press molding apparatus capable of preventing the occurrence of delayed fracture in a molded product is provided.

7 Claims, 9 Drawing Sheets

(51) Int. Cl.

| | |
|---|---|
| ***B21D 24/04*** | (2006.01) |
| ***B21D 24/16*** | (2006.01) |
| ***B21D 28/14*** | (2006.01) |

(56) References Cited

U.S. PATENT DOCUMENTS

| | | | | |
|---|---|---|---|---|
| 2011/0219841 | A1* | 9/2011 | Domange | B21D 37/16 72/342.3 |
| 2014/0017443 | A1 | 1/2014 | Matsuda | |
| 2019/0247906 | A1 | 8/2019 | Serizawa et al. | |
| 2020/0346268 | A1* | 11/2020 | Serizawa | B21D 24/04 |

FOREIGN PATENT DOCUMENTS

| | | | |
|---|---|---|---|
| JP | 2003-103313 | A | 4/2003 |
| JP | 2005-248253 | A | 9/2005 |
| JP | 2008-068282 | A | 3/2008 |
| JP | 2008-266721 | A | 11/2008 |
| JP | 2010-501358 | A | 1/2010 |
| JP | 2011-092946 | A | 5/2011 |
| JP | 2014-018801 | A | 2/2014 |
| JP | 2017-024035 | A | 2/2017 |
| JP | 2017-024036 | A | 2/2017 |
| JP | 6256571 | B1 | 1/2018 |
| WO | 2018/083814 | A1 | 5/2018 |

OTHER PUBLICATIONS

International Preliminary Report on Patentability received for PCT Patent Application No. PCT/JP2021/041842, mailed on Jul. 13, 2023, 11 pages (6 pages of English Translation and 5 pages of Original Document).

International Search Report and Written Opinion received for PCT Patent Application No. PCT/JP2021/041842, mailed on Jan. 25, 2022, 15 pages (7 pages of English Translation and 8 pages of Original Document).

Notice of Reasons for Refusal received for Japanese Patent Application No. 2020-219128, mailed on Apr. 6, 2021, 11 pages (6 pages of English Translation and 5 pages of Original Document).

* cited by examiner

RESIDUAL STRESS COMPARISON BASED ON PRESENCE/ABSENCE OF COOLING SUPPRESSION SPACE

HOT-PRESS MOLDING APPARATUS, AUTOMOTIVE BODY COMPONENT, HOT-PRESS MOLDING METHOD, AND AUTOMOTIVE BODY COMPONENT MANUFACTURING METHOD

TECHNICAL FIELD

The present invention relates to a hot-press molding apparatus for molding a metal sheet material and trimming an unnecessary portion, an automotive body component molded by this hot-press molding apparatus, a hot-press molding method of molding a metal sheet material and trimming an unnecessary portion, and an automotive body component manufacturing method.

BACKGROUND ART

Patent Literature 1 describes an example of a conventional hot-press molding apparatus capable of molding a metal sheet material and trimming an unnecessary portion. This hot-press molding apparatus disclosed in Patent Literature 1 is so configured that a mold functions as both a die and a punch. A metal sheet material to be loaded into this hot-press molding apparatus includes a molding portion to be molded into a predetermined shape by the mold, and a trimming portion as an unnecessary portion outside the molding portion.

The die is so formed as to overlap the entire region of the metal sheet material, and has a recessed portion for molding. The punch is so formed as to fit in the recessed portion of the die while overlapping the molding portion of the metal sheet material. Also, a holder for holding the trimming portion of the metal sheet material by sandwiching the trimming portion in cooperation with the die is movably installed on the side of the punch. The holder is biased toward the die by the spring force of a spring, and so configured as to sandwich the trimming portion in cooperation with the die from the beginning of molding to the end of trimming.

This hot-press molding apparatus described in Patent Literature 1 has a configuration that suppresses the occurrence of delayed fracture by performing trimming in a state in which the metal sheet material is unhardened. Delayed fracture is a phenomenon in which fracture abruptly occurs after the elapse of a given time under static loading at room temperature.

RELATED ART LITERATURE

Patent Literature

Patent Literature 1: International Publication No. 2018/083814

DISCLOSURE OF INVENTION

Problem to be Solved by the Invention

Unfortunately, the effect of preventing delayed fracture is insufficient when trimming is simply performed in an unhardened state. This is presumably because the trimming portion is sandwiched between the holder and the die from the beginning of trimming in the hot-press molding apparatus described in Patent Literature 1. When the trimming portion is thus sandwiched between the holder and the die, the temperature of the trimming portion decreases, and this makes it difficult to cut the trimming portion during trimming. Consequently, a tensile residual stress as one cause of the occurrence of delayed fracture increases in the end portion of a trimmed molded product.

It is an object of the present invention to provide a hot-press molding apparatus, an automotive body component, a hot-press molding method, and an automotive body component manufacturing method, each of which can prevent the occurrence of delayed fracture in a molded product.

Means of Solution to the Problem

To achieve this object, a hot-press molding apparatus according to the present invention includes a first mold configured to mold a metal sheet material heated to a predetermined temperature, and having a molding surface for molding a to-be-molded portion of the metal sheet material and a blade serving as a punch in an outer end portion of the molding surface, a second mold having a molding surface for sandwiching and molding the to-be-molded portion in cooperation with the first mold, and a die configured to separate, from the to-be-molded portion, a trimming portion positioned outside the to-be-molded portion of the metal sheet material in which the to-be-molded portion is molded by the first mold and the second mold, in cooperation with the blade of the first mold, wherein an outer side surface of the first mold is formed to extend in a cutting direction of the punch, and defines a cooling suppression space to which the trimming portion is exposed and which suppresses cooling of the trimming portion on the side of the first mold.

An automotive body component according to the present invention is an automotive body component in which a to-be-molded portion is molded into a predetermined shape and a trimming portion outside the to-be-molded portion is cut by the abovementioned hot-press molding apparatus, wherein a cut end face of the to-be-molded portion includes a shear surface, and a residual stress of the cut end face measured by an X-ray diffraction method is 50 MPa or more and 250 MPa or less.

A hot-press molding method according to the present invention is a method to be performed by a step of overlaying a to-be-molded portion of a metal sheet material heated to a predetermined temperature on a first mold, and sandwiching and holding an outer edge portion of a trimming portion positioned outside the to-be-molded portion of the metal sheet material by using a holder, thereby forming, between the first mold and the holder, a cooling suppression space that extends from the trimming portion in a cutting direction of a punch along an outer side surface of the first mold and suppresses cooling of an inner portion of the trimming portion, which is not held by the holder, a step of molding the to-be-molded portion of the metal sheet material by sandwiching the to-be-molded portion between the first mold and the second mold, and a step of moving the molded metal sheet material in the cutting direction together with the holder, the first mold, and the second mold, and separating the trimming portion from the to-be-molded portion by using a die configuring a cutting mechanism in cooperation with a punch formed by an outer end portion of the molding surface of the first mold.

An automotive body component manufacturing method according to the present invention is a method to be performed by a step of overlaying a metal sheet material for an automotive body component heated to a predetermined temperature between a first mold and a second mold of the abovementioned hot-press molding apparatus, and a step of molding the metal sheet material for an automotive body component by a hot stamp method by using the hot-press molding apparatus.

Effect of the Invention

In the present invention, the trimming portion of the metal sheet material is hardly cooled because the trimming portion is exposed to the cooling suppression space without touching any other member. Therefore, the punch and the die can cut the boundary portion between the trimming portion and the portion to be molded at a high temperature. The tensile residual stress of a molded product thus trimmed at a high temperature decreases.

Accordingly, it is possible to provide a hot-press molding apparatus and a hot-press molding method each capable of preventing the occurrence of delayed fracture in a molded product.

BEST MODE FOR CARRYING OUT THE INVENTION

First Embodiment

To explain the present invention, an embodiment capable of explaining all the claims of the present invention will be described in detail first as the first embodiment with reference to FIGS. 1 to 8. FIGS. 1 to 4 depict only the left-side half of a hot-press molding apparatus viewed in the longitudinal direction of a material to be molded. Note that FIGS. 1 to 5 schematically illustrate the hot-press molding apparatus to make the configuration of the present invention easy to understand, so a metal sheet material as a material to be molded is drawn to be thicker than an actual material.

Figure 1:
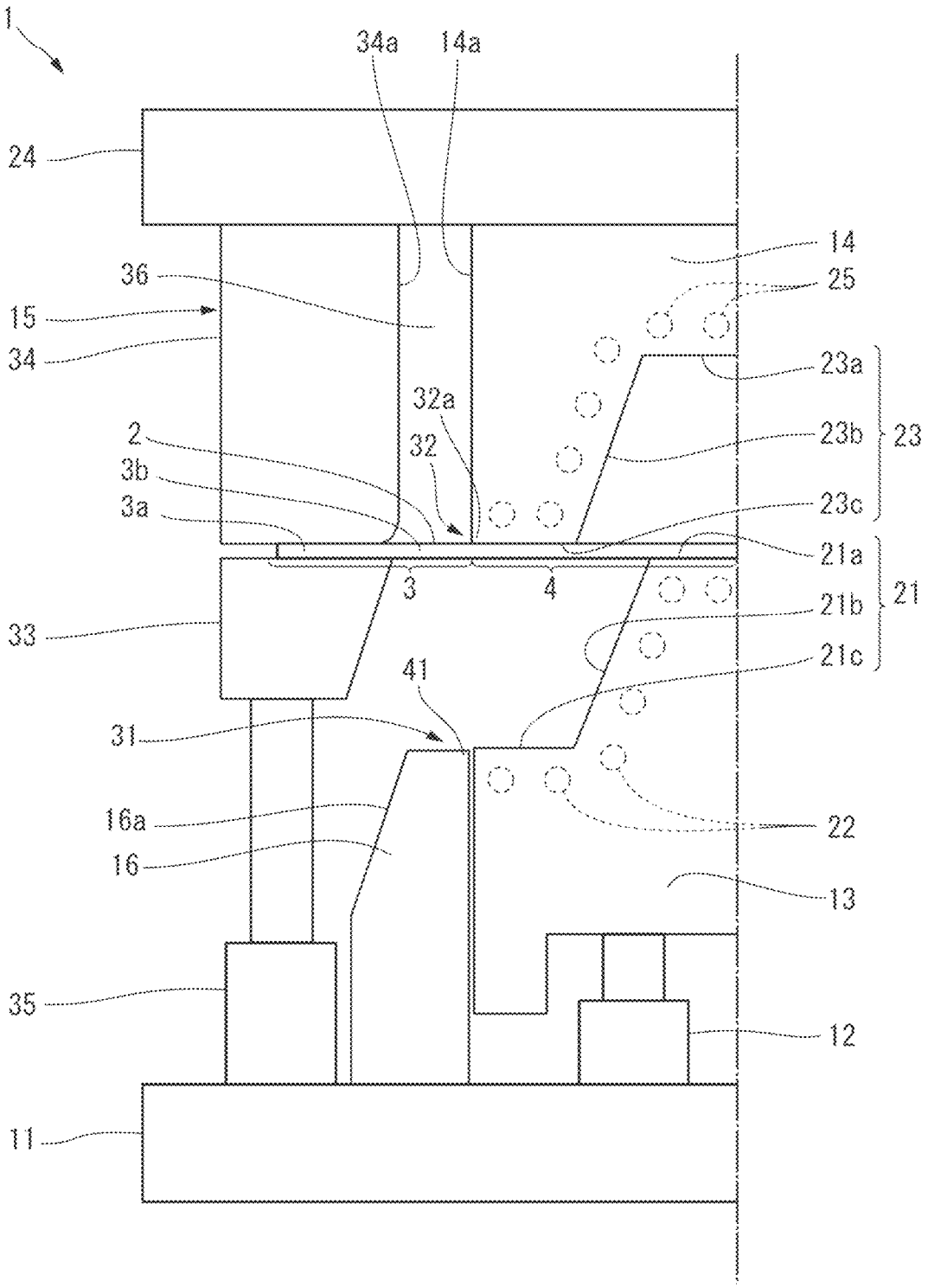
FIG. 1 is a front view showing a part of a hot-press molding apparatus according to the first embodiment.
Figure 2:
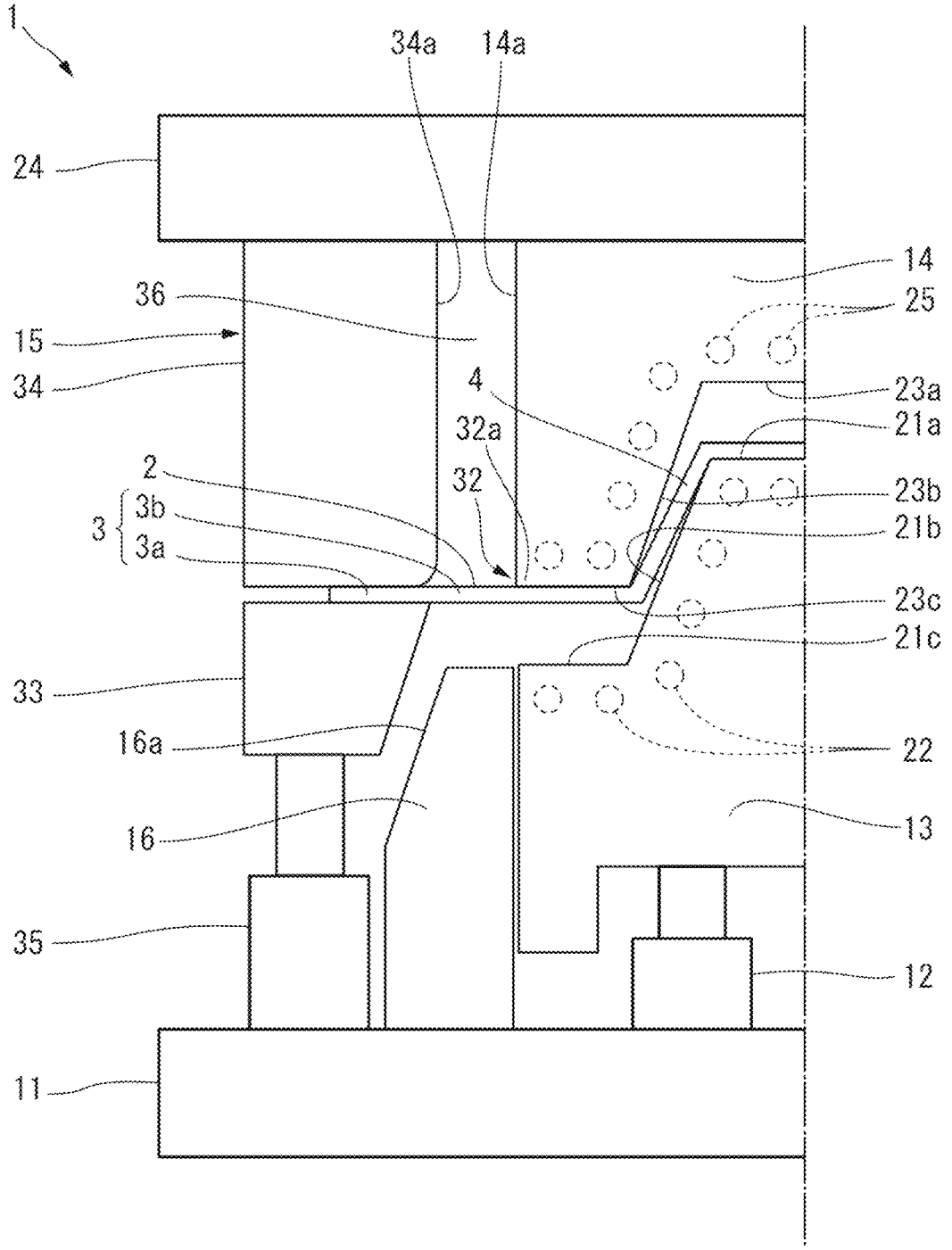
FIG. 2 is a front view showing the part of the hot-press molding apparatus during molding.

A hot-press molding apparatus 1 shown in FIG. 1 molds a metal sheet material 2 (a material to be molded) heated to a predetermined temperature into a predetermined shape, and trims the metal sheet material 2. As the metal sheet material 2, it is possible to use a metal sheet material for an automotive body component or 22MnB5 (boron steel). The thickness of the metal sheet material 2 is desirably 0.8 mm to 2.9 mm.

Trimming herein mentioned is to separate a trimming portion 3 as an unnecessary portion of the metal sheet material 2 from a to-be-molded portion 4. FIG. 1 shows a state immediately before molding. The to-be-molded portion 4 is a portion to be molded into a predetermined shape by the hot-press molding apparatus 1.

The hot-press molding apparatus 1 according to this embodiment includes, e.g., a lower mold 13 supported, via a first elevator 12, on a base 11 depicted in the lowermost portion in FIG. 1, an upper mold 14 facing the lower mold 13, a blank holder 15 so arranged as to be aligned with the lower mold 13 and the upper mold 14, and a die 16 arranged between the lower mold 13 and the blank holder 15.

The first elevator 12 is given a configuration that regulates descent of the lower mold 13 during molding, and permits descent of the lower mold 13 during trimming such that the lower mold 13 descends together with the upper mold 14. Although not shown in detail, the first elevator 12 as described above can be configured by using, e.g., a compression coil spring, a hydraulic cylinder, or a servo motor as the power generation source.

A molding surface 21 for molding the metal sheet material 2 in cooperation with the upper mold 14 (to be described later) is formed on the upper end of the lower mold 13. That is, the lower mold 13 is so configured as to be movable in the thickness direction of the metal sheet material 2. In this embodiment, the lower mold 13 is equivalent to "a second mold" of the present invention.

The lower mold 13 and the upper mold 14 are so configured as to mold the metal sheet material 2 into a hat-like sectional shape that projects upward. For this purpose, the lower mold 13 includes a first molding surface 21*a* extending laterally in the highest position, a second molding surface 21*b* that is an inclined surface extending diagonally downward from the first molding surface 21*a*, and a third molding surface 21*c* extending laterally from the lower end of the first molding surface 21*b*. In addition, the lower mold 13 has a refrigerant passage 22 in order to cool the first to third molding surfaces 21*a* to 21*c* to a predetermined temperature.

The upper mold 14 has a molding surface 23 facing the lower mold 13, and is supported by an upper-mold holder 24. The molding surface 23 of the upper mold 14 is formed into a shape in which the projecting portion of the lower mold 13 fits. The molding surface 23 includes a first molding surface 23*a* facing the first molding surface 21*a* of the lower mold 13, a second molding surface 23*b* that is an inclined surface extending diagonally downward from the first molding surface 23*a*, and a third molding surface 23*c* extending laterally from the lower end of the second molding surface 23*b*. The upper mold 14 has a refrigerant passage 25 for cooling the first to third molding surfaces 23*a* to 23*c* to a predetermined temperature. Although not shown, the upper mold 14 can be divided into a plurality of parts so as to perform molding precisely on each molding surface.

When dividing the upper mold 14 into a plurality of parts, the upper mold 14 can be divided into, e.g., a first upper mold having the first molding surface 23*a*, and a second upper mold having the second and third molding surfaces 23*b* and 23*c*. In this case, the first upper mold moves in only the vertical direction (the thickness direction of the metal sheet material 2), and pushes the metal sheet material 2 against the first molding surface 21*a* of the lower mold 13. The second upper mold moves in a direction perpendicular to the second molding surface 23*b* or the horizontal direction, and in the vertical direction, and pushes the metal sheet material 2 against the second molding surface 21*b* and the third molding surface 21*c* of the lower mold 13.

An outer end portion that is a lower end portion having the third molding surface 23*c* of the upper mold 14 and is adjacent to the blank holder 15 (to be described later) is formed to be a punch 32 which is configured to cooperate with the die 16 (to be described later) to form a cutting mechanism 31. More specifically, the upper mold 14 has a blade 32*a* functioning as the punch 32 in the outer end portion of the molding surface 23.

The punch 32 is so formed that a direction from the upper mold 14 to the lower mold 13 is a cutting direction. An outer side surface 14*a* of the upper mold 14, which extends upward from the punch 32, is formed by a plane parallel to the molding direction (the vertical direction in FIG. 1).

The upper-mold holder 24 for supporting the upper mold 14 is connected to a pressurizing device (not shown) and moves up and down by being driven by the pressurizing device. The upper-mold holder 24 moves down from an initial position shown in FIG. 1 in order to perform molding and trimming, and moves up to the initial position after trimming that is performed in succession from molding is completed. That is, the upper mold 14 is so configured as to be movable in the cutting direction of the punch 32. In this embodiment, the upper mold 14 is equivalent to "a first mold" of the present invention.

The blank holder 15 includes a lower holder 33 and an upper holder 34 that sandwich and hold an outer edge portion 3*a* of the trimming portion 3 of the metal sheet material 2. In this embodiment, the blank holder 15 is equivalent to "a holder" of the present invention.

The lower holder 33 is supported on the base 11 so as to be movable up and down via a second elevator The second elevator 35 is so configured that a substantially constant load is applied from the lower holder 33 to the trimming portion 3 of the metal sheet material 2 regardless of the position of the metal sheet material 2 in the vertical direction. The second elevator 35 like this can be configured by using, e.g., a compression coil spring, a hydraulic cylinder, or a servo motor as the power generation source.

The upper holder 34 is so positioned as to be laterally spaced apart by a predetermined distance from the upper mold 14, and is fixed to the upper-mold holder 24. Accordingly, the upper holder 34 and the above-described lower holder 33 move in the cutting direction of the punch 32 in synchronism with the lower mold 13 and the upper mold 14.

The upper holder 34 is so formed as to continuously extend from one end to the other of the metal sheet material 2, in the longitudinal direction of the metal sheet material 2 (a direction perpendicular to the paper surface of FIG. 1).

The length of the upper holder 34 in the vertical direction is substantially equal to that of the upper mold 14 in the vertical direction. As shown in FIG. 1, therefore, the to-be-molded portion 4 of the metal sheet material 2 overlaps the third molding surface 23*c* of the upper mold 14 when the trimming portion 3 of the metal sheet material 2 is sandwiched and held by the lower holder 33 and the upper holder 34. In this state, a cooling suppression space 36 that is a space extending in the cutting direction of the punch 32 (in this embodiment, the vertical direction) from the trimming portion 3 to the outer side surface 14*a* of the upper mold 14 is formed between the upper mold 14 and the blank holder 15. As will be described in detail later, the cooling suppression space 36 is a space to which an inner portion 3*b* of the metal sheet material 2, which is not held by the blank holder 15, is exposed, and which suppresses cooling of the inner portion 3*b* on the side of the upper mold 14.

The cooling suppression space 36 is surrounded by, e.g., the outer side surface 14*a* of the upper mold 14, an inner side surface 34*a* of the upper holder 34, the upper-mold holder 24, and the trimming portion 3 of the metal sheet material 2, and opened to the atmosphere on the two sides of the metal sheet material 2 in the longitudinal direction (on the front side and the back side of the paper surface of FIG. 1). The upper holder 34 according to this embodiment is spaced apart from the upper mold 14 by a length of about 5 to 7 times the thickness of the metal sheet material 2 so that the cooling suppression space 36 has a sufficient volume. For example, the spacing between the upper mold 14 and the upper holder 34 is about 10 mm when the thickness of the metal sheet material 2 is 2 mm. The spacing between the upper mold 14 and the upper holder 34, i.e., the width of the cooling suppression space 36 is preferably 10 mm to 30 mm. Note that although not shown, the upper end portion of the upper holder 34 and that of the upper mold 14 can also be connected by a connecting portion extending in the lateral direction.

The die 16 forms the cutting mechanism 31 in cooperation with the punch 32 of the upper mold 14, has a trimming blade 41 in the upper end, and is fixed on the base 11 so that the die 16 is positioned near the side of the lower mold 13. The height of the die 16, i.e., the height of the upper end where the trimming blade 41 is highest, is lower than the third molding surface 21*c* of the lower mold 13 when molding is completed (see FIG. 3). This means that the metal sheet material 2 is spaced apart from the die 16 when molding is completed. Therefore, the lower mold 13, the upper mold 14, and the blank holder 15 are so configured that the metal sheet material 2 moves toward the die 16 after molding is completed, thereby separating the trimming portion 3 from the to-be-molded portion 4. Note that the height of the die 16 can also be set such that the trimming blade 41 comes in contact with the metal sheet material 2 before molding is completed. That is, the metal sheet material 2 is preferably spaced apart from the die 16 until molding is completed, but can also come in contact with the die 16 during molding.

Figure 4:
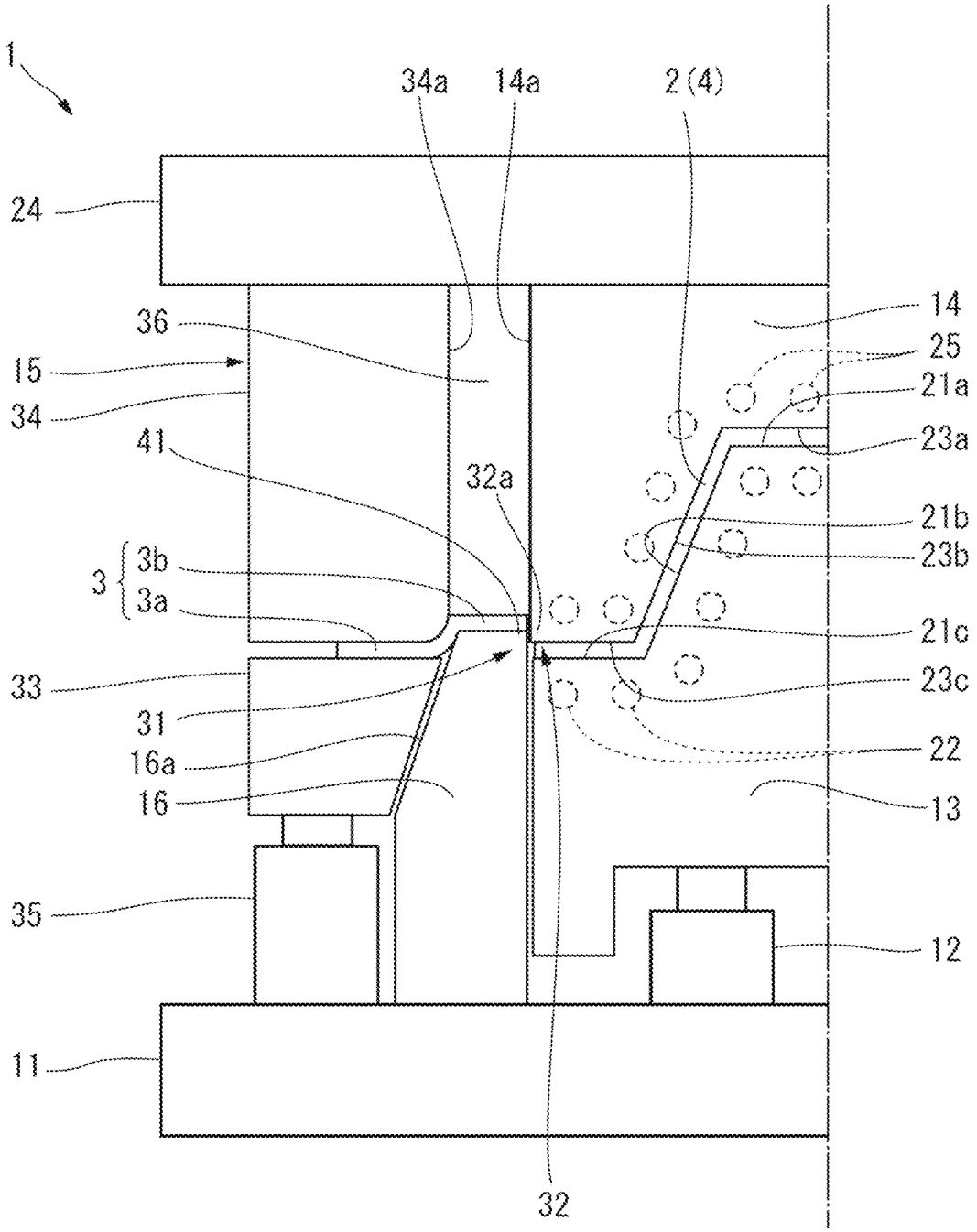
FIG. 4 is a front view showing the part of the hot-press molding apparatus when trimming is completed.

The width of the upper end portion including the trimming blade 41 of the die 16 (the width in a direction in which the die 16 and the lower mold 13 are aligned) is slightly narrower than the width of the cooling suppression space 36 described above (the spacing between the upper mold 14 and the upper holder 34). The reason why the die 16 is formed as described above is to prevent contact between the die 16 and the upper holder 34 when performing cutting (to be described later), as shown in FIG. 4. That is, the upper end portion including the trimming blade 41 of the die 16 is so configured that the blank holder 15 can enter the cooling suppression space 36 while sandwiching and holding the outer edge portion of the trimming portion 3.

An outer side surface 16*a* of the upper end portion of the die 16 according to this embodiment is inclined so that the thickness of the die 16 gradually increases toward the base 11. This improves the rigidity of the die 16. The outer side surface 16*a* is desirably so formed as to incline at 20° to 25° with respect to the vertical direction.

Figure 5:
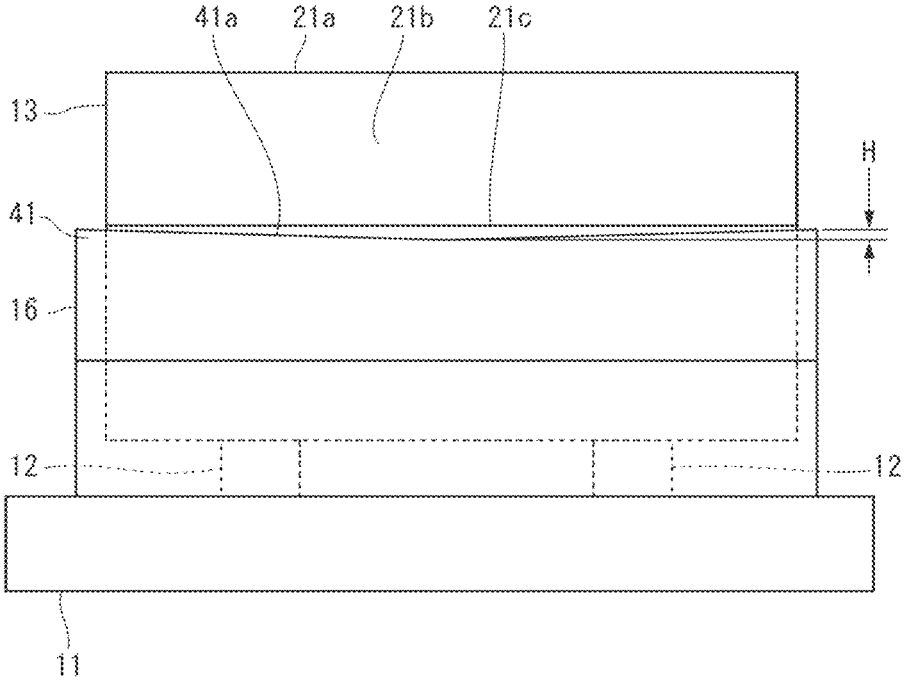
FIG. 5 is a side view of a die and a lower mold.
Figure 6:
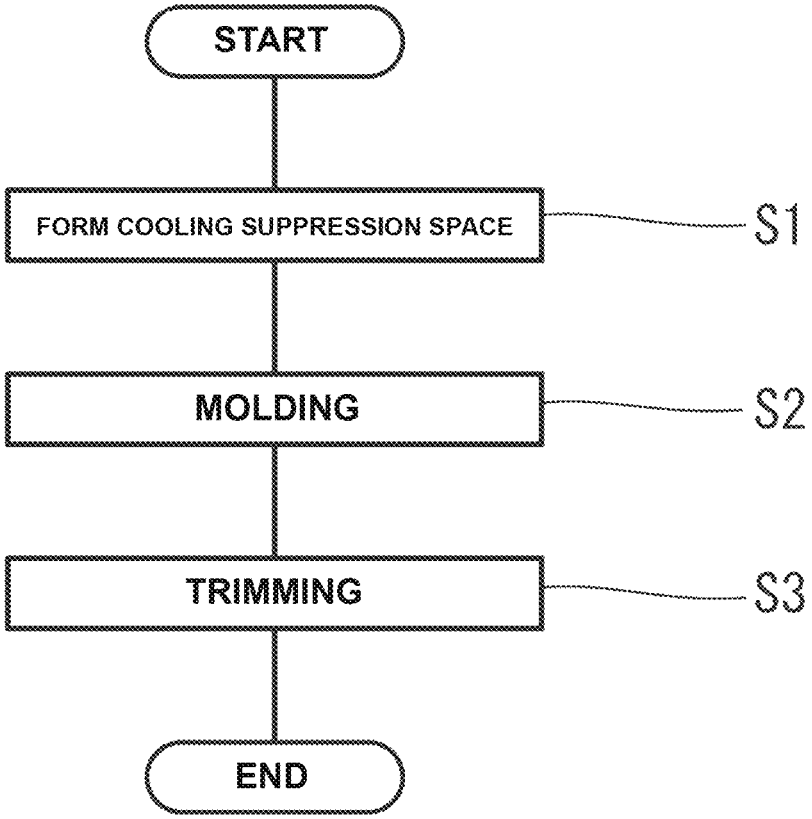
FIG. 6 is a flowchart for explaining a hot-press molding method according to the present invention.

As shown in FIG. 5, a blade edge 41*a* of the trimming blade 41 is so formed as to have a shearing angle that forms a predetermined height H with respect to the third molding surface 21*c* of the lower mold 13, which extends in a direction perpendicular to the molding direction (in FIG. 5, the vertical direction). The height H is the difference between the lowest portion of the trimming blade 41 formed into a valley shape in the side view shown in FIG. 5, and the highest portions in the two ends of the trimming blade 41. This shearing angle height is ⅓ to 1 time the thickness of the metal sheet material 2.

The trimming blade 41 is formed in a position lower than the third molding surface 21*c* of the lower mold 13 in the molding position. Note that the shape of the trimming blade 41 is not limited to the valley shape having a lower central portion as shown in FIG. 5, and can also be, e.g., a mountain shape having a higher central portion, a shape that obliquely linearly extends from one end to the other, or a shape having no shearing angle.

Next, a hot-press molding method of molding and trimming the metal sheet material 2 by using the above-described hot-press molding apparatus 1 will be explained. This hot-press molding method is performed as shown in a flowchart of FIG. 6. In the hot-press molding apparatus 1 for performing this hot-press molding method, a refrigerant is always supplied to the refrigerant passages 22 and 25 and keeps the temperatures of the lower mold 13 and the upper mold 14 at a predetermined temperature. To perform the hot-press molding method, the metal sheet material 2 is first loaded into the hot-press molding apparatus 1, thereby forming the cooling suppression space 36 (step S1).

That is, the trimming portion 3 of the metal sheet material 2 heated to a predetermined temperature is sandwiched and held by the lower holder 33 and the upper holder 34 of the blank holder 15, and the to-be-molded portion 4 of the metal sheet material 2 is overlaid on the third molding surface 23*c* of the upper mold 14. This cooling suppression space formation step can be performed in a state in which the metal sheet material 2 is in contact with the lower mold 13 and the upper mold 14 as shown in FIG. 1, or in a state in which a gap is formed between the metal sheet material 2 and the lower mold 13 although not shown.

By thus loading the metal sheet material 2 into the hot-press molding apparatus 1, the inner portion 3*b* (see FIG. 1) of the trimming portion 3, which is not sandwiched by the lower holder 33 and the upper holder 34, is exposed to the cooling suppression space 36 without touching any other member. This keeps the temperature of the inner portion 3*b* of the trimming portion 3 at a high temperature before molding.

Then, the hot-press molding apparatus 1 performs molding (step S2). Molding is performed by moving down the upper holder 24 by the pressurizing device. When the upper holder 24 moves down, the state shown in FIG. 1 changes to the state shown in FIG. 2. That is, the to-be-molded portion 4 of the metal sheet material 2 is held in the initial position by being supported by the first molding surface 21*a* of the lower mold 13, and is pushed downward by the third molding surface 23*c* of the upper mold 14. As a consequence, the to-be-molded portion 4 is bent along the second molding surfaces 21*b* and 23*b*. In this state, the lower holder 33 and the upper holder 34 of the blank holder 15 move down while sandwiching the trimming portion 3 so as to follow the upper mold 14.

Figure 3:
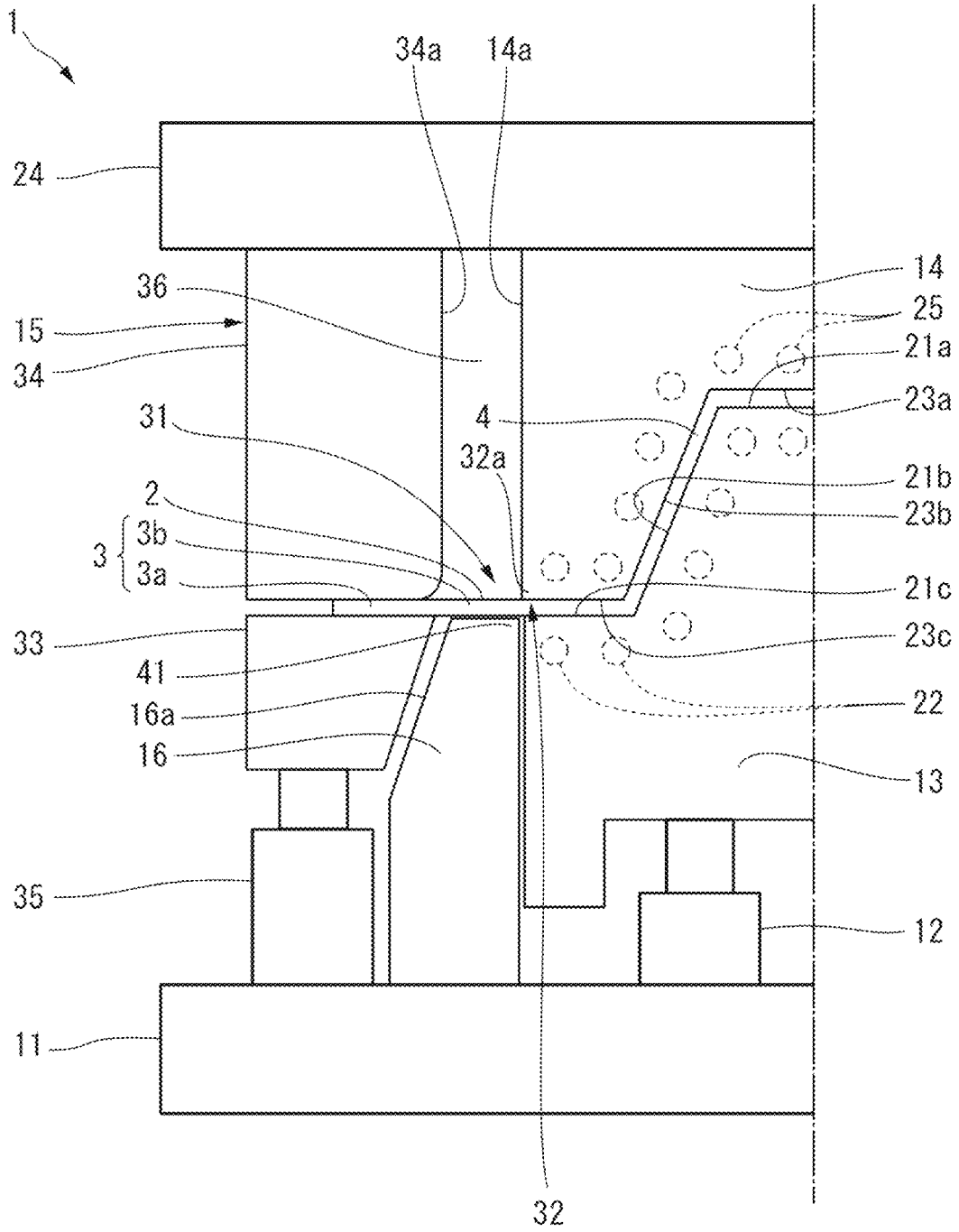
FIG. 3 is a front view showing the part of the hot-press molding apparatus when molding is completed.

Subsequently, as shown in FIG. 3, the upper-mold holder 24 descends until the first to third molding surfaces 23*a* to 23*c* of the upper mold 14 push the metal sheet material 2 against the first to third molding surfaces 21*a* to 21*c* of the lower mold 13, thereby molding the metal sheet material 2 into a shape conforming to the first to third molding surfaces 21*a* to 21*c* and 23*a* to 23*c*, and quenching the metal sheet material 2 by rapidly cooling it in contact with the lower mold 13 and the upper mold 14. In a molding completed state shown in FIG. 3, the trimming blade 41 of the die 16 is spaced apart from the metal sheet material 2. However, the trimming blade 41 can also be in contact with the metal sheet material 2 in this molding completed state.

After molding and quenching are thus performed, trimming is performed by further lowering the upper holder 24 (step S3).

Trimming is performed by lowing the lower mold 13, the upper mold 14, the lower holder 33, and the upper holder 34 in a state in which they are sandwiching and holding the metal sheet material 2, such that they are positioned below the die 16. Since the metal sheet material 2 is positioned below the molding position, as shown in FIG. 4, the trimming blade 41 of the die 16 cuts the boundary portion between the to-be-molded portion 4 and the trimming portion 3, thereby separating the trimming portion 3 from the to-be-molded portion 4. In this state, the upper end portion including the trimming blade 41 of the die 16 enters the cooling suppression space 36 while the lower holder 33 and the upper holder 34 are sandwiching and holding the outer edge portion of the trimming portion 3. Also, the inner portion 3*b* of the trimming portion 3 is exposed to the cooling suppression space 36 even after trimming is completed. That is, the inner portion 3*b* is always exposed to the cooling suppression space 36.

Of the trimming portion 3 of the metal sheet material 2, the inner portion 3*b* not held by the blank holder 15 is hardly cooled because it is not in contact with any other member and is always exposed to the cooling suppression space 36. Therefore, the punch 32 and the die 16 can cut the boundary portion between the trimming portion 3 and the to-be-molded portion 4 at a high temperature. The tensile residual stress of a molded product trimmed at a high temperature as described above decreases.

Accordingly, this embodiment can provide a hot-press molding apparatus and a hot-press molding method each capable of preventing the occurrence of delayed fracture in a molded product.

The lower mold 13 (the second mold), the upper mold 14 (the first mold), and the blank holder 15 according to this embodiment are so configured that the metal sheet material 2 moves toward the die 16 after molding is completed, thereby separating the trimming portion 3 from the to-be-molded portion 4.

Since, therefore, the trimming portion 3 of the metal sheet material 2 is not cooled by the die 16 during molding, a temperature drop of the trimming portion 3 can be decreased as much as possible. Therefore, a delayed fracture occurs more hardly.

The die 16 according to this embodiment has a shearing angle having the predetermined height H. This makes it possible to reduce the shear load during cutting, and further decrease the tensile residual stress of the metal sheet material 2, thereby preventing the occurrence of a delayed fracture more reliably.

Figure 7:
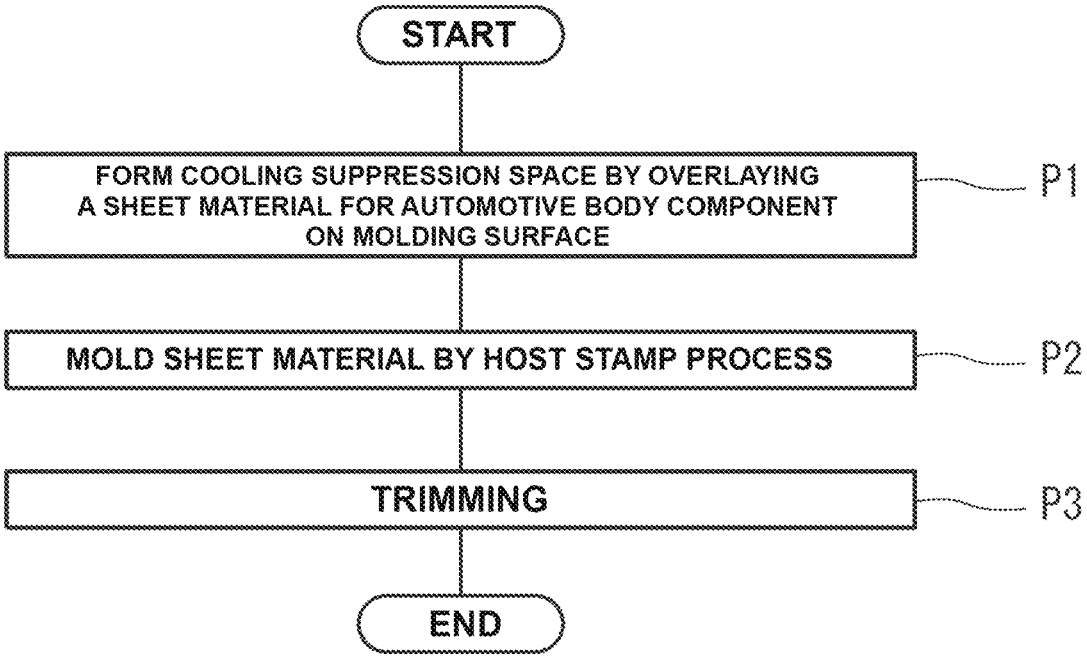
FIG. 7 is a flowchart for explaining an automotive body component manufacturing method according to the present invention.

An automotive body component can be manufactured by using the hot-press molding apparatus 1 disclosed in the above-described embodiment, as shown in a flowchart of FIG. 7. Note that in the following explanation, the same reference numerals as explained with reference to FIGS. 1 to 6 denote the same or equal members, and a detailed explanation thereof will suitably be omitted.

To manufacture an automotive body component by using the hot-press molding apparatus 1 disclosed in the above-described embodiment, the metal sheet material 2 for the automotive body component is first loaded into the hot-press molding apparatus 1, and overlaid on the third molding surface 23*c* of the upper mold 14 (step P1). The cooling suppression space 36 is formed by thus loading the metal sheet material 2 into the hot-press molding apparatus 1. Then, the metal sheet material 2 is sandwiched between the upper mold 14 and the lower mold 13 and molded by a hot stamp process (step P2). Subsequently, trimming is performed by moving down the upper mold 14, the lower mold 13, and the blank holder 15 such that the metal sheet material 2 comes in contact with the die 16 (step P3). This trimming cuts the trimming portion 3 outside the to-be-molded portion 4 (see FIG. 8).

Figure 8:
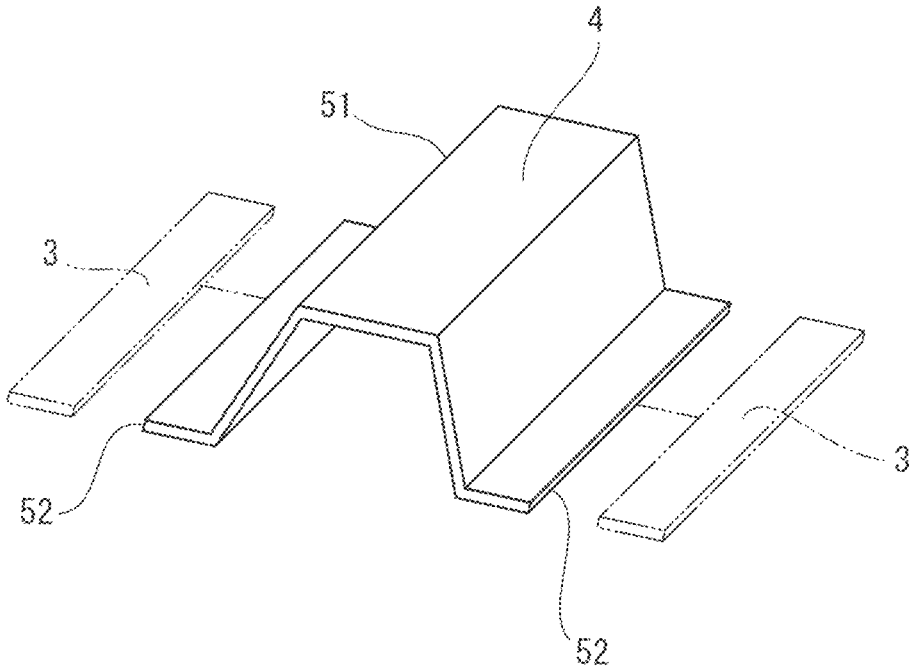
FIG. 8 is a perspective view showing an example of an automotive body component.

After trimming is performed, an automotive body component 51 as shown in FIG. 8 can be obtained by unloading the metal sheet material 2 from the hot-press molding apparatus 1.

A cut end face 52 of the trimmed to-be-molded portion 4 of the automotive body component 51 includes a shear surface (to be described later), and it is generally known that a cut end face cut by a punch and a die forms "undercut" when a blade cuts into a plate, and includes "a shear surface" as a mark formed when the blade cuts into the plate, "a fracture surface" as a portion separated at once, and "a burr" generated by the clearance between upper and lower blades at the time of separation.

Second Embodiment

An example of a hot-press molding apparatus according to the invention described in claim 1 will be explained below with reference to FIG. 9. The same reference numerals as explained with reference to FIGS. 1 to 5 denote the same or equal members in FIG. 9, and a detailed explanation thereof will suitably be omitted.

Figure 9:
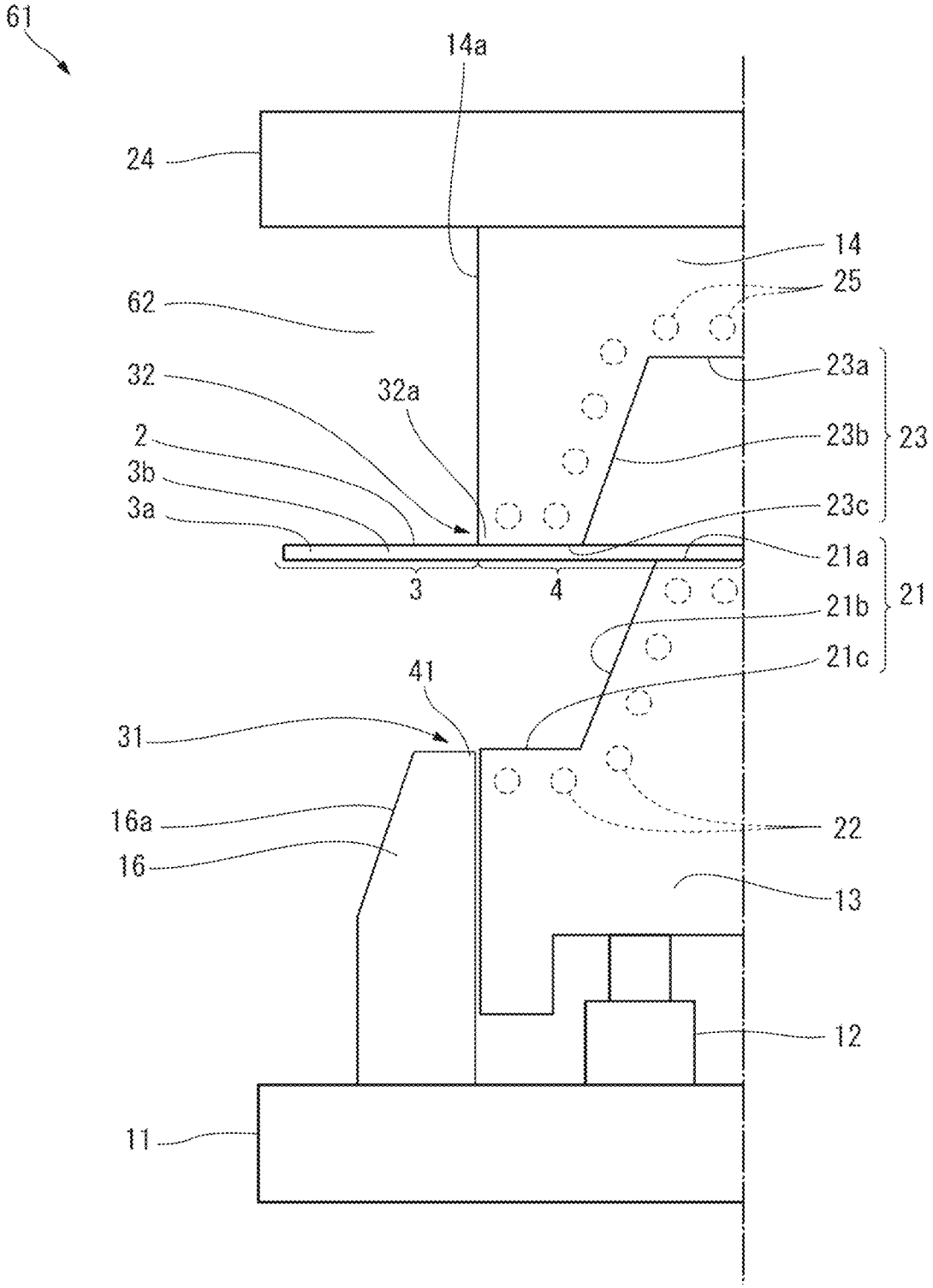
FIG. 9 is a front view showing a part of a hot-press molding apparatus according to the second embodiment.

A hot-press molding apparatus 61 shown in FIG. 9 has the same configuration as that the hot-press molding apparatus 1 disclosed in the first embodiment, except that the hot-press molding apparatus 61 does not include the holder 15.

A cooling suppression space 62 as a space to which a trimming portion 3 of a metal sheet material 2 is exposed is formed on the side of an upper mold 14 of the hot-press molding apparatus 61 according to this embodiment. That is, an outer side surface 14*a* of the upper mold 14 is formed to extend in the cutting direction of a punch 32, and defines, on the side of the upper mold 14, the cooling suppression space 62 to which the trimming portion 3 is exposed and which suppresses cooling of the trimming portion 3.

Even when adopting this embodiment, therefore, the trimming portion 3 of the metal sheet material 2 is hardly cooled because it is exposed to the cooling suppression space 62 without touching any other member. Accordingly, the boundary portion between the trimming portion 3 and a to-be-molded portion 4 can be cut by the punch 32 and a die 16 at a high temperature. The tensile residual stress of a molded product thus trimmed at a high temperature decreases.

This makes it possible to provide a hot-press molding apparatus capable of preventing the occurrence of a delayed fracture in a molded product in this embodiment as well.

Figure 10:
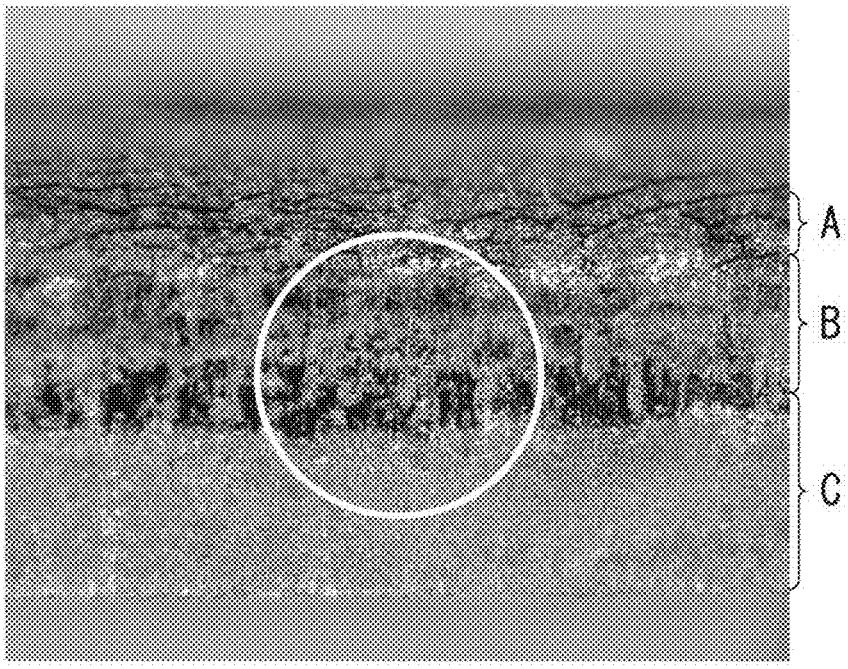
FIG. 10 is a photomicrograph of a cut end face.

FIG. 10 shows a cut end face formed when trimming the trimming portion 3 by using the punch 32 and the die 16 without holding it as disclosed in this embodiment. Referring to FIG. 10, a range denoted by reference symbol A is a portion so-called "undercut", a range denoted by reference symbol B is a portion so-called "shear surface", and a range denoted by reference symbol C is a portion so-called "fracture surface".

Figure 11:
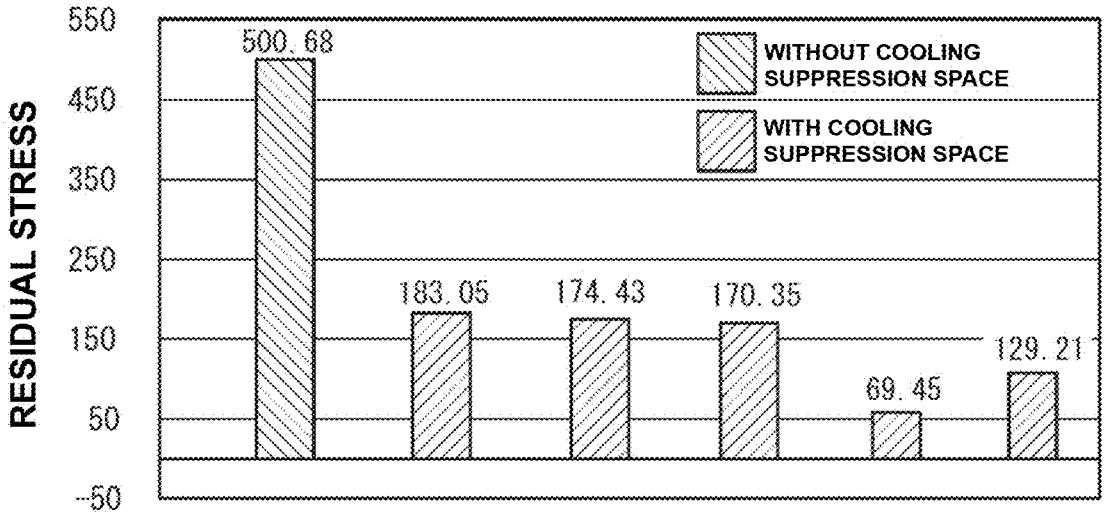
FIG. 11 is a graph for explaining the relationship between the presence/absence of a cooling suppression space and the residual stress.

The results as shown in FIG. 11 were obtained when trimming the metal sheet material 2 by using the hot-press molding apparatus 61 disclosed in the second embodiment, and examining the residual stress of the cut end face of the to-be-molded portion 4. The residual stress was measured by an X-ray diffraction method within a range enclosed by a white circle in FIG. 10. This white circle in FIG. 10 is a circle having a diameter of 1 mm and centering around the "shear surface" positioned in the central portion of the cut end face. As the test conditions for performing the X-ray diffraction method, an X-ray stress measurement method is a $\sin^2\phi$ method, and a scanning method is an iso-inclination method. A stress constant (K[MPa/deg]) is −318.

When examining the residual stress, only one residual stress was examined by using, as a comparative example, the residual stress when there was no cooling suppression space, i.e., when the entire area of the trimming portion 3 was held by a holder as in a conventional hot-press molding apparatus. When there was a cooling suppression space, i.e., when the whole front and back surfaces of the trimming portion 3 were exposed to the cooling suppression space 62, the residual stress was examined for five specimens. As shown FIG. 11, the residual stress was about 500 MPa when there was no cooling suppression space. On the other hand, when there was a cooling suppression space, the residual stress was 50 MPa or more and 250 MPa or less by considering variations in clearance between the upper mold 14 and the die 31 during trimming, and variations in temperature and the like of the metal sheet material 2.

Accordingly, in an automotive body component 51 (see FIG. 8) in which the to-be-molded portion 4 was molded into a predetermined shape and the trimming portion 3 outside the to-be-molded portion 4 was cut by the hot-press molding apparatus 61 disclosed in the second embodiment, the residual stress of a cut end face 52 measured by the X-ray diffraction method was 50 MPa or more and 250 MPa or less.

All the residual stresses of the five specimens shown in FIG. 11 were 200 MPa or less. Therefore, the hot-press molding apparatus, the hot-press molding method, and the automotive body component manufacturing method according to the present invention can manufacture an automotive body component in which no delayed fracture occurs because the residual stress of the cut end face is 200 MPa or less.

When the hot-press molding apparatus 61 disclosed in the second embodiment was used, i.e., when molding and trimming were performed at the same time in a state in which the whole front and back surfaces of the trimming portion 3 were exposed to the cooling suppression space 62, the hardness (Vickers hardness) of the cut end face was 503 Hv on the upstream side in the cutting direction, 472 Hv in the central portion in the cutting direction, and 507 Hv on the downstream side in the cutting direction, i.e., satisfied the Company Quality Standard that is a hardness of 450 Hv or more on the end face.

Figure 12:
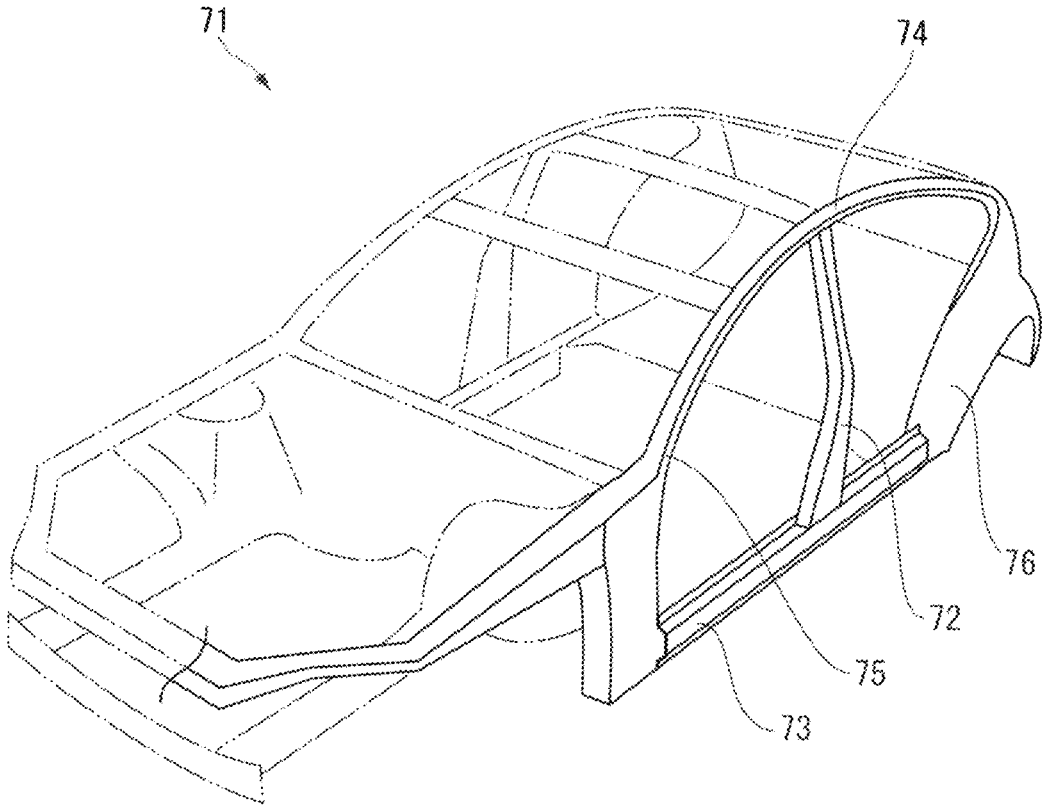
FIG. 12 is a perspective view showing an outline of the configuration of a body frame of an automobile.

As shown in FIG. 12, the automotive body component 51 can be used as, e.g., a center pillar 72 of a body frame 71 of an automobile, and can also be used as a side sill 73. The center pillar 72 is a body component for connecting the side sill 73 and a roof 74. The side sill 73 is a body component extending in the front-back direction of the body in two end portions in the right-and-left direction of the body. The lower end portion of a front pillar 75, the lower end portion of the center pillar 72, and the lower end portion of a rear pillar 76 are welded to the side sill 73.

In the above-described embodiment, the hot-press molding apparatus 1 having the structure in which the upper-mold holder 24 comes close to and moves away from the base 11 that does not move has been explained, but the present invention is not limited to this. That is, it is also possible to adopt a configuration in which the upper-mold holder 24 is immobile and the base 11 comes close to and moves away from the upper-mold holder 24. In this case, the upper-mold holder 24 is arranged in the lower end portion of the apparatus, and the base 11 is arranged in the upper end portion of the apparatus. The upper mold 14 and the upper holder 34 are mounted on the upper-mold holder 24, and the lower mold 13, the die 16, and the lower holder 33 are arranged below the base 11.

EXPLANATION OF THE REFERENCE NUMERALS AND SIGNS

1, 61 . . . hot-press molding apparatus, 2 . . . metal sheet material, 3 . . . trimming portion, 3*a* . . . outer edge portion, 3*b* . . . inner portion, 4 . . . to-be-molded portion, 13 . . . lower mold (second mold), 14 . . . upper mold (first mold), 14*a* . . . outer side surface, 16 . . . die, 31 . . . cutting mechanism, 32 . . . punch, 32*a* . . . blade, 36, 62 . . . cooling suppression space, 51 . . . automotive body component, 52 . . . cut end face, S1 . . . cooling suppression space formation step, S2, P2 . . . molding step, S3, P3 . . . trimming step, P1 . . . cooling suppression space formation step

The invention claimed is:

1. A hot-press molding apparatus comprising:

a first mold configured to mold a metal sheet material heated to a predetermined temperature, the first mold having a molding surface for molding a to-be-molded portion of the metal sheet material and a blade provided in an outer end portion of the molding surface and configured to function as a punch;

a second mold having a molding surface for sandwiching and molding the to-be-molded portion in cooperation with the first mold;

a die configured to separate, from the to-be-molded portion, a trimming portion positioned outside the to-be-molded portion of the metal sheet material, and a holder arranged to be aligned with the first mold and the second mold, the holder configured to move in a cutting direction of the punch in synchronism with the first mold and the second mold while sandwiching and holding an outer edge portion of the trimming portion, wherein an outer side surface of the first mold is formed to extend in the cutting direction of the punch, and defines, on the side of the first mold, a cooling suppression space to which the trimming portion is exposed and which suppresses cooling of the trimming portion, the holder has an inner side surface facing the outer side surface of the first mold, the cooling suppression space is surrounded by the outer side surface, the inner side surface, and an inner portion of the trimming portion, which is not held by the holder, and the inner portion of the trimming portion, which is not held by the holder, is always exposed to the cooling suppression space.

2. The hot-press molding apparatus according to claim 1, wherein the die has a trimming blade in one end facing the metal sheet material, and a one end portion including the trimming blade of the die is configured to enter the cooling suppression space in a state in which the holder sandwiches and holds the outer edge portion of the trimming portion.

3. The hot-press molding apparatus according to claim 1, wherein the first mold, the second mold, and the holder are configured such that the metal sheet material moves toward the die and the trimming portion is separated from the to-be-molded portion after molding is completed.

4. The hot-press molding apparatus according to claim 1, wherein the die has a shearing angle having a predetermined height.

5. An automotive body component manufacturing method comprising:

overlaying a metal sheet material for an automotive body component heated to a predetermined temperature between the first mold and the second mold of the hot-press molding apparatus according to claim 1; and molding the metal sheet material for the automotive body component by a hot stamp process by using the hot-press molding apparatus.

6. A hot-press molding method comprising:

overlaying a to-be-molded portion of a metal sheet material heated to a predetermined temperature on a first mold, and sandwiching and holding an outer edge portion of a trimming portion positioned outside the to-be-molded portion of the metal sheet material by using a holder, thereby forming, between the first mold and the holder, a cooling suppression space that extends from the trimming portion in a cutting direction of a punch along an outer side surface of the first mold and suppresses cooling of an inner portion of the trimming portion, which is not held by the holder;

molding the to-be-molded portion of the metal sheet material by sandwiching the to-be-molded portion between the first mold and a second mold; and moving the molded metal sheet material in the cutting direction of the punch together with the holder, the first mold, and the second mold, and separating the trimming portion from the to-be-molded portion by using a die configuring a cutting mechanism in cooperation with the punch formed in an outer end portion of the molding surface of the first mold.

7. The hot-press molding method according to claim 6, wherein separating the trimming portion from the to-be-molded portion is performed by using the die having a trimming blade in one end facing the metal sheet material, and when separating the trimming portion from the to-be-molded portion, a one end portion including the trimming blade of the die enters the cooling suppression space in a state in which the holder sandwiches and holds the outer edge portion of the trimming portion.

* * * * *